US010441068B2

(12) United States Patent
Premananda

(10) Patent No.: US 10,441,068 B2
(45) Date of Patent: Oct. 15, 2019

(54) BRUSH CLEANER

(71) Applicant: Ganeshananda Roshan Premananda, Brick, NJ (US)

(72) Inventor: Ganeshananda Roshan Premananda, Brick, NJ (US)

( * ) Notice: Subject to any disclaimer, the term of this patent is extended or adjusted under 35 U.S.C. 154(b) by 0 days.

(21) Appl. No.: 16/066,767

(22) PCT Filed: Dec. 28, 2016

(86) PCT No.: PCT/US2016/068792

§ 371 (c)(1),
(2) Date: Jun. 28, 2018

(87) PCT Pub. No.: WO2017/117170

PCT Pub. Date: Jul. 6, 2017

(65) Prior Publication Data

US 2019/0021482 A1 Jan. 24, 2019

Related U.S. Application Data

(60) Provisional application No. 62/271,569, filed on Dec. 28, 2015.

(51) Int. Cl.

| | |
|---|---|
| ***A46B 17/06*** | (2006.01) |
| ***B08B 3/10*** | (2006.01) |
| ***B44D 3/00*** | (2006.01) |
| ***B06B 1/04*** | (2006.01) |
| ***B08B 3/08*** | (2006.01) |

(52) U.S. Cl.

CPC ..... *A46B 17/06* (2013.01); *B06B 1/045* (2013.01); *B08B 3/08* (2013.01); *B08B 3/10* (2013.01); *B44D 3/006* (2013.01); *A46B 2200/1046* (2013.01); *A46B 2200/1066* (2013.01); *A46B 2200/202* (2013.01); *B06B 2201/71* (2013.01)

(58) Field of Classification Search

CPC . A46B 17/06; A46B 2200/1053; B06B 1/045; B08B 3/08; B08B 3/10; B08B 11/02; B44D 3/006; A45D 44/00

See application file for complete search history.

(56) References Cited

U.S. PATENT DOCUMENTS

| | | | | |
|---|---|---|---|---|
| 9,380,860 | B1 * | 7/2016 | Taylor | A46B 17/06 |
| 2014/0096801 | A1 * | 4/2014 | McCormick | B08B 11/02 134/115 R |
| 2018/0264875 | A1 * | 9/2018 | Mongan | B44D 3/006 |

* cited by examiner

*Primary Examiner* — Shay Karls

(57) ABSTRACT

Methods and apparatus for cleaning brushes quickly, comfortably and efficiently are disclosed. The apparatus contains at least one cleaning chamber comprising a plurality of cleaning elements disposed within the chamber that contacts the brushes during cleaning, the cleaning chamber in contact with a) a drive and a motor that can deliver rapid reciprocating motions to the cleaning elements, b) a solvent flow system, and c) a removable brush holder connected to a motor that turns the brushes slowly over the cleaning elements. Rapid reciprocating motions of the cleaning elements, continuous flow of a solvent over the brushes to be cleaned and a slow rotation of the brush itself over the cleaning elements achieve rapid cleaning of brushes with little damage to the brush itself. A removable brush holder that can accommodate many different kinds of brushes in the same slot extends the functionality and comfort of using the brush cleaner.

20 Claims, 10 Drawing Sheets

BRUSH CLEANER

PRIORITY INFORMATION

This application claims priority to the PCT application PCT/US2016/068792 filed on Dec. 28, 2016 which claims priority to the provisional application No. 62/271,569, filed on Dec. 28, 2015 entitled "Brush Cleaner" and are incorporated herein by reference.

BACKGROUND

Cosmetic or makeup brushes are used to apply makeup and various cosmetic products to body parts. Many of the brushes are very expensive. In addition, some of them carry great personal value. Most makeup and cosmetic products are sticky and hard to remove from the brushes and accumulated residue affect the use of cosmetic brushes. Prompt cleaning is required for complete removal of these residues immediately after use as because the longer they stay on the brushes it is more difficult to remove, as they dry up and become hard. If the brushes are to be shared, cleaning in-between uses is also required to maintain personal hygiene. A common solution to clean the makeup brushes is to clean manually under running water, which is time consuming and inefficient.

Mechanical brush cleaners are used to clear away dirt and debris from artist paint brushes, building paint brushes, hair brushes, make up brushes, scrub brushes, wheel brushes and the like. Mechanical scrubbing of brushes increases the efficiency of dirt and debris removal. Further, mechanical scrubbing can be done with or without the aid of water or other solvents. Therefore, it is common to find the use of power-operated machines or brush cleaners for mechanical scrubbing and cleaning of various types of brushes either alone or in combination with water or other solvents.

Current mechanical brush cleaners exploit the motions of rubbing the brushes against a cleaning head or surface. Such methods are less efficient and time consuming, and may also cause considerable damage to brushes' bristles during the cleaning process. Thus, there is a great need in personal care and other industries for more efficient and timesaving brush cleaners.

SUMMARY

Disclosed herein are methods and systems for a device for cleaning brushes. In some embodiments, a brush cleaner comprises a base and at least one vibratory motor mounted on the base, wherein the vibratory motor comprises a permanent magnet and an electromagnet. In some embodiments, at least one vibratory motor is connected to a drive, wherein the drive is configured to provide circular reciprocating motions. Further, at least one cleaning chamber is in contact with the drive, and a plurality of cleaning elements are disposed within the cleaning chamber. In addition, at least one detachable brush holder comprising a proximal end and a distal end is present as part of the brush cleaner, and the proximal end of the brush holder contacts the base, and the distal end comprises a brush securement member connected to a rotary motor. The brush cleaner further has a reservoir attached to the base.

In some embodiments, the permanent magnet is in close proximity to the electromagnet and the permanent magnet is configured to vibrate in response to fluctuating magnetic field of electromagnet.

In some embodiments, the vibratory motor is connected to the drive by a shaft, wherein the proximal end of the shaft is attached to the drive and a distal end is attached to the permanent magnet of the vibratory motor.

In some embodiments, the shaft and the drive are configured to convert the vibratory motions of the permanent magnet into circular reciprocating motions.

In some embodiments, the cleaning chamber is detachable from the drive. Further, the cleaning chamber is made of polymer material selected from polyoxymethylene (POM), acrylonitrile butadiene styrene (ABS), polyurethane, a polyester, an epoxy resin, a phenolic resin, polyethylene (PE), polypropylene (PP), polyvinyl chloride, polystyrene, or any combination thereof.

In some embodiments, the cleaning chamber has a height of about 1 inch to about 16 inches, and a diameter of about 1 inch to about 16 inches.

In some embodiments, the cleaning chamber is configured to undergo circular reciprocating motions of about 10-1000 times per second.

In some embodiments, a plurality of cleaning elements are disposed at a bottom of the cleaning chamber, and the cleaning elements are about 0.1 inches to 3 inches in length, and about 0.1 inches to 3 inches in thickness. The cleaning elements are made of polymer material selected from polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof.

In some embodiments, the brush securement member of the brush holder is configured to hold and rotate one or more brushes above the cleaning chamber. Further, the brush securement member is configured to undergo 20-200 rotations per minute.

In some embodiments, the rotary motor of the brush holder is configured to operate when the brush holder contacts the base of the brush cleaner.

In some embodiments, the reservoir comprises a solvent flow system that is configured to circulate a solvent between the cleaning chamber and the reservoir.

In some embodiments, the brush cleaner further includes a housing encasing the at least one vibratory motor, drive, and part of the base of the brush cleaner.

In some embodiments, the brush cleaner further includes at least one solvent dispensing port adjacent to the at least one cleaning chamber.

In additional embodiments, a brush cleaner includes a base, and a first vibratory motor mounted on the base and a second vibratory motor mounted on the base, wherein each vibratory motor comprises a permanent magnet and an electromagnet. Further, the first vibratory motor is connected to a first drive, wherein the first drive is configured to provide first circular reciprocating motions, and the second vibratory motor connected to a second drive, wherein the second drive is configured to provide second circular reciprocating motions, and wherein the first and the second circular reciprocal motions may be identical or different. The brush cleaner also includes a first cleaning chamber in contact with the first drive, and a second cleaning chamber in contact with the second drive. The brush cleaner further includes at least one detachable brush holder comprising a proximal end and a distal end, the proximal end in contact with the base, and the distal end comprising a brush securement member connected to a rotary motor. The brush cleaner includes a reservoir attached to the base.

In an additional embodiment, a kit includes a brush cleaner comprising a motor-driven brush holder, a motor-driven cleaning chamber, and a reservoir attached to a base. The kit may also include a plurality of disposable cleaning elements, a plurality of cleaning heads and instructions to replace them. In addition, the kit also includes one or more solvents for cleaning brushes.

DETAILED DESCRIPTION

Figure 1:
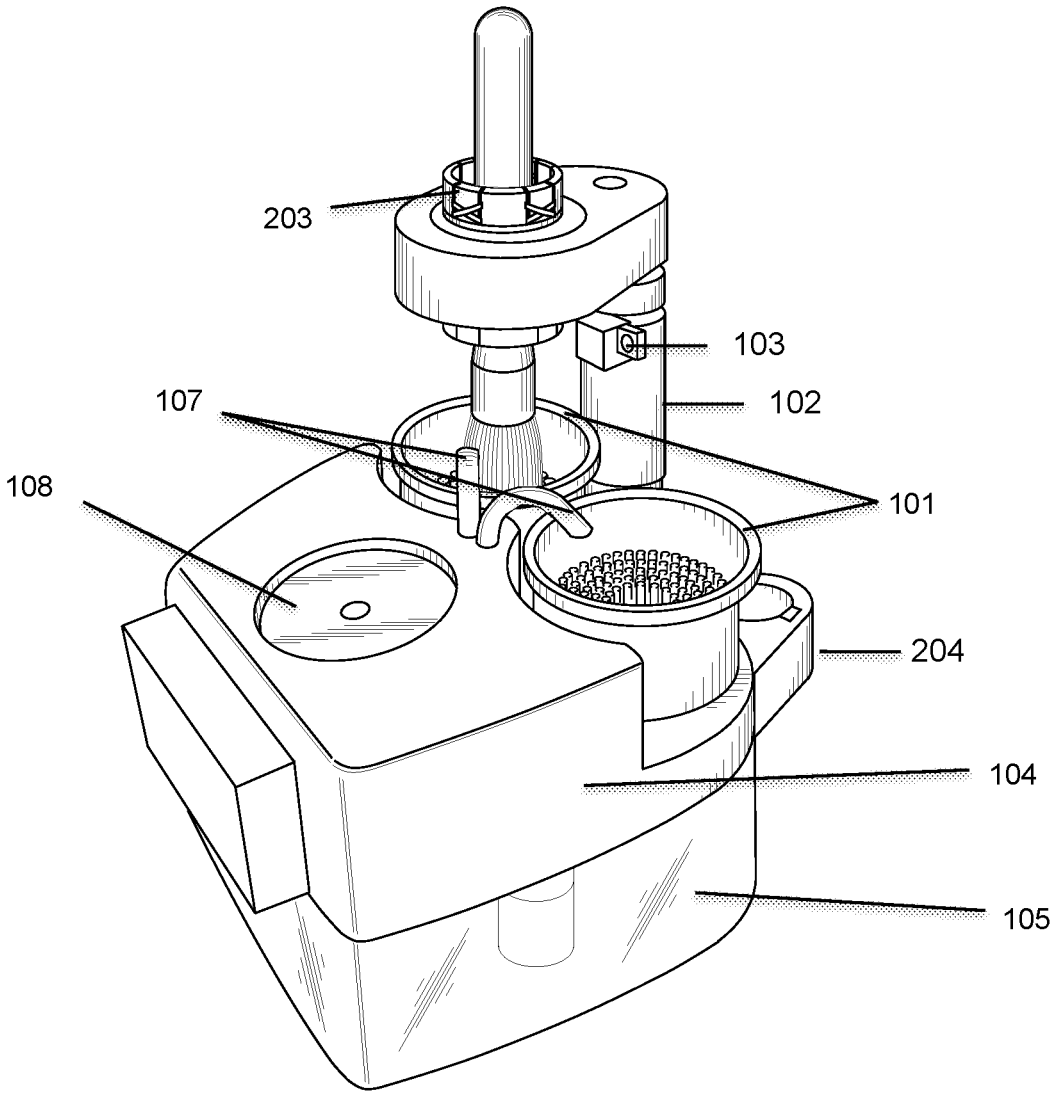
FIG. 1 depicts a brush cleaner with two cleaning chambers and a single brush holder according to an embodiment.

FIG. 1 depicts an exemplary embodiment of a brush cleaner with two cleaning chambers 101, and a detachable brush holder 102. Each cleaning chamber 101 is connected to a drive and a motor encased within a housing 104 of the brush cleaner. A reservoir 105 is present beneath the housing 104. A solvent flow system circulates water or a cleaning solution from the reservoir to the cleaning chamber through a port 107 that is present adjacent to the cleaning chamber. An operating switch 108 on the main body of the brush cleaner powers to all the motors in the brush cleaner.

Figure 2:
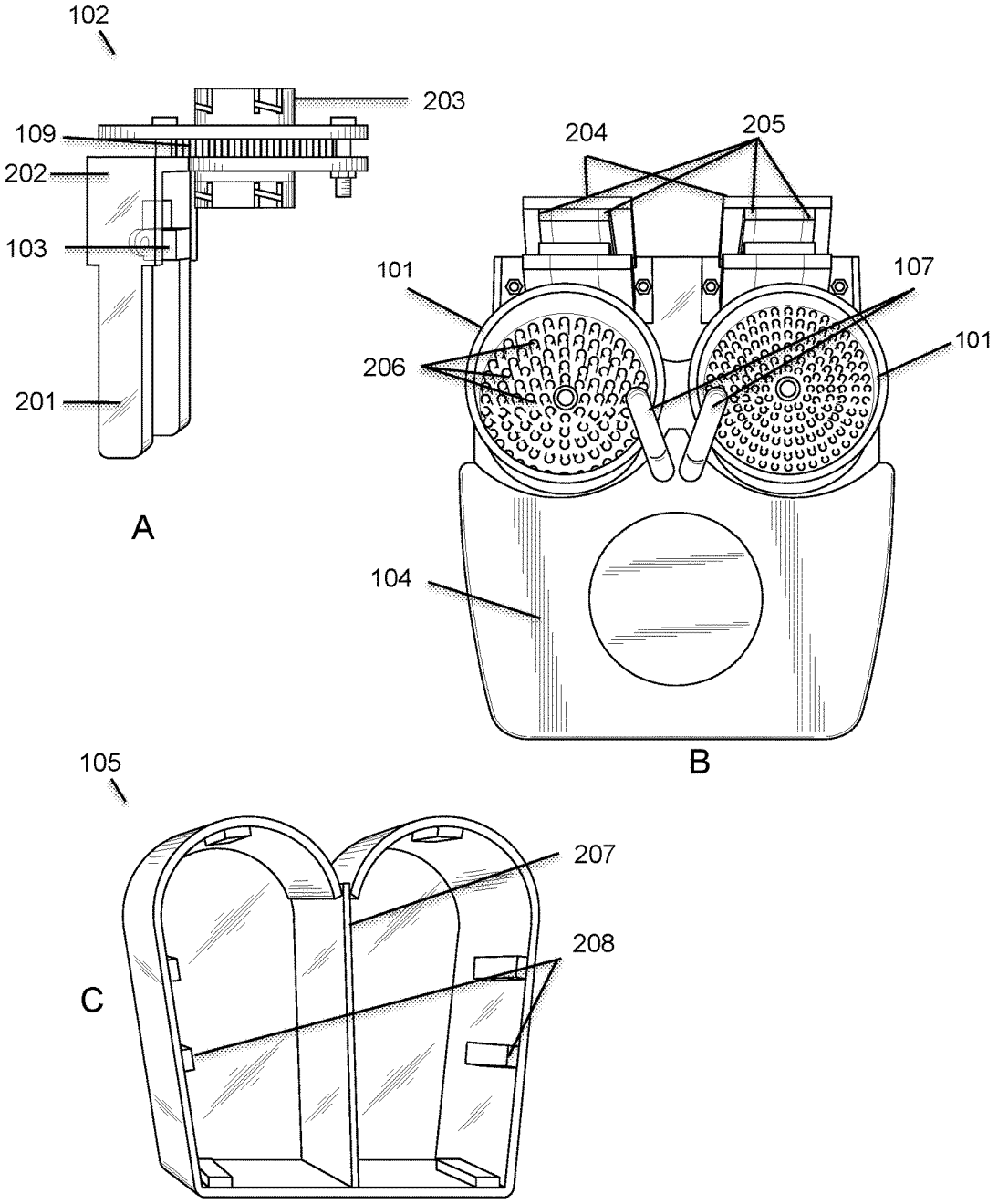
FIG. 2 depicts a detachable brush holder (A), top view of cleaning chambers (B) and reservoirs (C) according to an embodiment.
Figure 3:
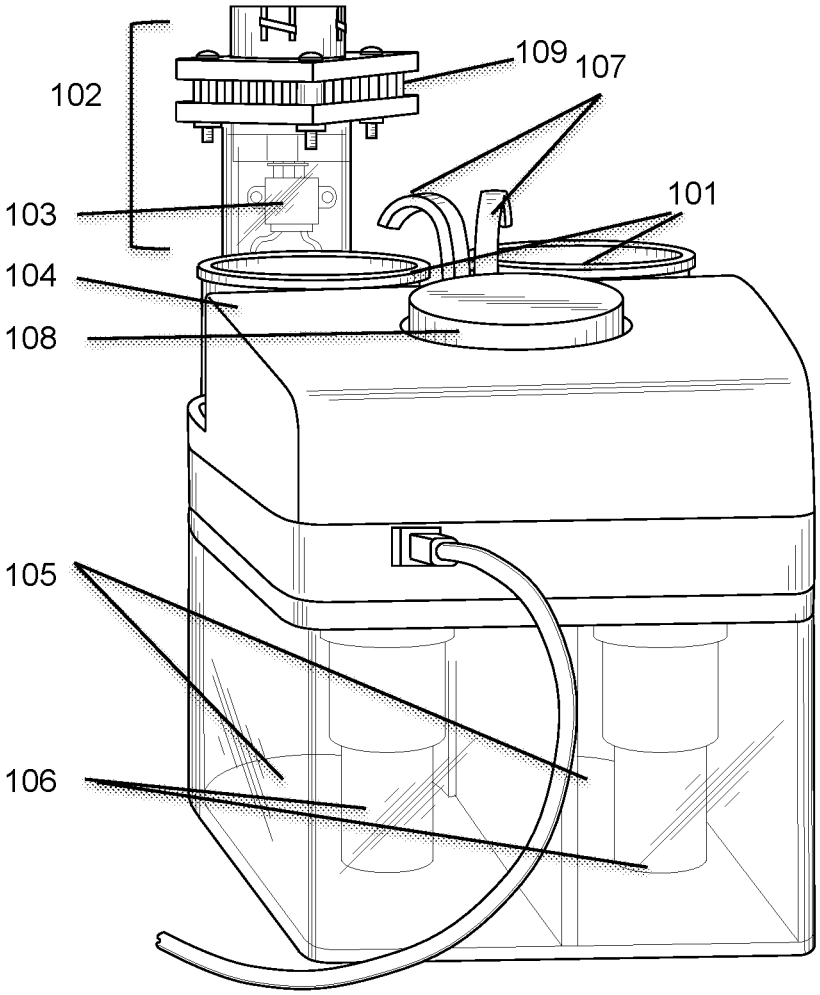
FIG. 3 depicts a front view of a brush cleaner with two cleaning chambers and a single brush holder according to an embodiment.

FIG. 2 depicts a brush cleaner with detachable parts comprising a housing 104 with cleaning chambers 101 (FIG. 2B), a brush holder 102 (FIG. 2A), and a reservoir 105 (FIG. 2C). The brush holder 102 has a proximal end 201 and a distal end 202. The distal end 202 of the brush holder carries brush securement member 203, which holds or secures one or more brushes. The brush securement member 203 is coupled to a rotary motor 103 and a drive 109 which allows the brush securement member to rotate clockwise or anti-clockwise (FIGS. 2A and 3). When the brush holder carrying one or more brushes is attached to the brush cleaner, the brush holder is positioned such that the brushes' bristles come in contact with the interior of the cleaning chamber 101.

Figure 4:
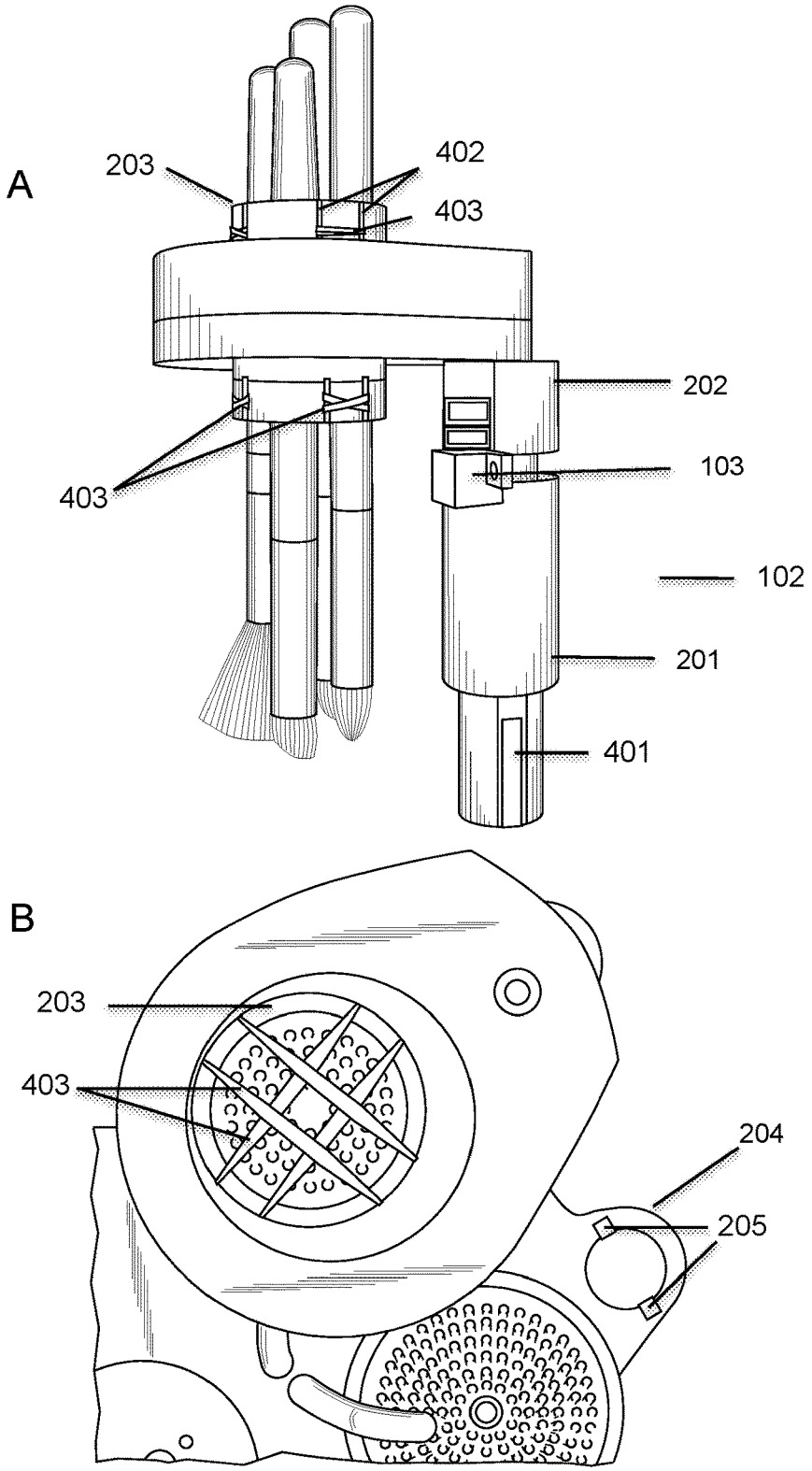
FIG. 4 depicts a brush holder (A) and top view of securement member (B) according to an embodiment.

As shown in FIG. 2 and FIG. 4, the proximal end 201 of the brush holder can fit into the receptacle 204 snugly. Thus, the brush holder 102 is attached to the brush cleaner through receptacles 204 present behind the cleaning chambers, and can be swapped between the two cleaning chambers. This feature helps to clean the brushes with multiple solvents or solutions. For example, a brush may be cleaned in the first cleaning chamber with a cleaning solution. After cleaning, the brush holder is attached to the second receptacle and the brushes are cleaned with water in the second cleaning chamber. The detachable feature of the brush holder 102 and its use between the two cleaning chambers makes it convenient for cleaning and rinsing the brushes with water to remove any residual detergents sticking to the bristles. In some embodiments, the brush cleaner may have one or more brush holders.

As shown in FIG. 4, the proximal end 201 of the brush holder carries the leads 401 from the rotary motor 103. When the brush holder is snapped into the receptacle 204, the leads 205 present on the receptacle contacts the leads 401 on the brush holder, thus completing the circuit. This contact turns on the rotary motor 103 instantaneously. Sliding the proximal end 201 off the receptacle 204 breaks the circuit and turns off the brush holder rotary motor 103. The shape of the proximal end 201 is configured such that it snugly fits into the receptacle 204 to complete the circuit. For example, in FIG. 2 the proximal end 201 is cuboidal shape and fits into rectangular shaped receptacle 204, whereas in FIG. 4 the proximal end 201 is cylindrical and fits into a circular shaped receptacle 204. Although the embodiments shown here are configured for the brush holder motor to start instantaneously, alternatives such as an independent switch to control the on/off status, or speed or duration of the brush holder can be made, if desired.

Further, the brush holder may be made transparent as shown in the embodiments in FIG. 2 and FIG. 3, exposing the drive 109, or it may be made solid and opaque as in FIG. 1, thereby hiding the drive 109 from plain sight. Similarly, the distal end of the brush holder 202 may be configured into different shapes and still hold the securement members 203. Non-limiting examples are the oval in FIG. 2 and FIG. 3 and cylindrical in FIG. 1. Further, the length of the brush holder 102 may vary in size depending on the type and the length of the brushes that are used for cleaning.

As shown in FIG. 4A, the distal end 202 of the brush holder carries a brush securement member 203. The brush securement member 203 has grooves 402 into which elastic bands 403 are inserted. A top view of the brush securement member 203 carrying the elastic bands 403 is shown in FIG. 4B. The example in FIG. 4A and FIG. 4B shows four sets of grooves that accommodate two elastic bands. This configuration of the brush securement member holds a range of the most commonly used cosmetic brushes securely for cleaning. Brushes can be inserted into these elastic bands to hold them securely during cleaning and drying. The number of grooves 402 and elastic bands 403 in the brush securement members 203 can be increased or spaced appropriately to accommodate any brush. Further, elastic bands 403 can be easily replaced by slipping them out of the grooves and replacing with new ones. In addition, a supply of disposable elastic bands 403 can be contemplated for replacement as and when needed. This lessens the worry of worn out, distorted or broken brush holders for the brush cleaner users.

As shown in FIGS. 1 and 2B, a brush cleaner may have two cleaning chambers 101. In some embodiments, the cleaning chambers may have can be of any shape such as cylindrical, square, triangular, conical, pyramidal, pentagonal, hexagonal and the like. In some embodiments, the cleaning chamber has a height from 1 inch to 16 inches, and diameter from 1 inch to 16 inches. The thickness of the walls of the cleaning chamber may be from 0.1 to 20 millimeters. The exemplary cleaning chamber 101 shown in FIG. 1 is cylindrical, 65 mm in diameter and has a wall that is 3 mm thick. The cleaning chamber may be made from polymers, such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. Alternatively, the cleaning chambers may be made from metals such as aluminum, silver, gold, copper, zinc, iron, silicon, and the like, or from metal alloys. In addition, cleaning chambers made largely with one material may be coated with another material or combination of materials by any of the means known in the art to give a different appearance. In some embodiments, the inner surface of the cleaning chamber may be coated with a hydrophobic or hydrophilic coatings. Further, such coatings may be carried out to enhance desirable surface properties of the cleaning chamber, for example to reduce stickiness of the surface for dirt and debris, or for aesthetic purposes. The cleaning chamber 101 may be also made from any of the plastics known in the art that is appropriate for high-load mechanical applications. The exemplary cleaning chamber 101 shown in FIG. 1 is made from Delcrin®Acetal.

As shown in FIG. 2B and according to an embodiment, the cleaning chamber 101 includes a plurality of cleaning elements 206 disposed on the inner bottom of the cleaning chamber and are configured to clean the bristles of the brushes during operation. The cleaning elements 206 can be solid, hollow, rigid or flexible rods ranging in size from 0.1 mm to 10 mm in diameter and 1 mm to 500 mm in length. The cleaning elements could be arranged individually, separated from each other by a distance between 0.1 mm to 30 mm. Alternatively, the cleaning elements could be arranged in groups with the groups themselves being separated from each other by a distance between 0.1 mm and 30 mm. For example, cleaning elements that are smaller in dimensions may be grouped. The cleaning elements may have cross sections that are largely circular, square, triangular, pentagonal, hexagonal and the like. They may be straight, curved or wavy. They may be arranged on any of the inner surfaces of the cleaning chamber such as sides, edges or bottom of the cleaning chamber. The cleaning elements 206 may be short, appearing as stubs within the chamber 101. They may be of dimensions smaller than the length of the cleaning chamber 101 such that the cleaning elements 206 do not extend outside the confines of a cleaning chamber. Alternatively, they may be longer and extend beyond the confines of the chamber 101. In some embodiments, the cleaning elements may be arranged in a defined pattern, such as in concentric circles. The cleaning elements may be of uniform length or may be of different lengths.

The cleaning elements 206 may be attached to the inner bottom of the cleaning chambers 101 by adhesives, screws, snug-fit, clamps, pins, nuts, threads, rivets and the like known in the art. The cleaning elements 206 may be made from any of the polymers such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof, metals such as aluminum, silver, gold, copper, zinc, iron, silicon, and the like, or metal alloys. Further, the cleaning elements may be coated with another material to increase performance and aesthetics or bring in desirable characteristics such as non-stickiness. In some embodiments, the bottom surface of the cleaning chamber may contain sockets with grooves, and the cleaning element may be threaded into the socket so that they fit into the socket tightly.

In the exemplary embodiment in FIG. 2B, the cleaning elements 206 of one of the cleaning chambers 101 are shown as rod shaped elements, which are 2 mm in diameter and 10 mm long, and made of Acrylonitrile Butadiene Styrene (ABS). The rods are permanently attached to the socket present on the bottom of the cleaning chamber with an adhesive. The cleaning elements in the second cleaning chamber are of different size, made of rod shaped elements that are 3 mm in diameter and 15 mm length.

A brush holder 102 may position the bristles of a single large cosmetic brush against the cleaning elements 206 as shown in FIG. 1 or it may position the bristles of up to four smaller cosmetic brushes against the cleaning elements 206 as shown in FIG. 4A.

Figure 10:
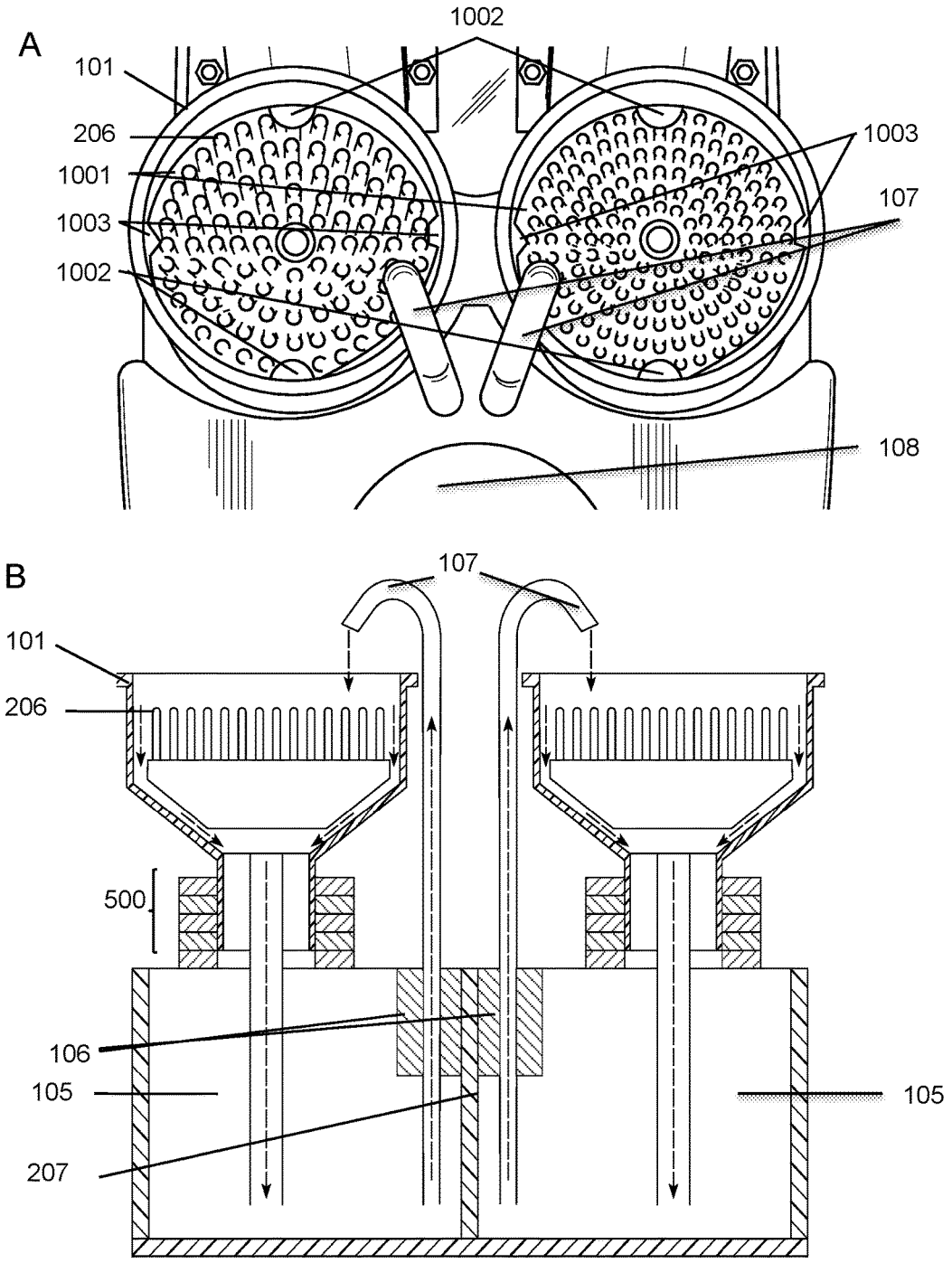
FIG. 10 depicts a top view of the cleaning chamber (A) and the schematics of a flow system attached to the reservoir (B) according to an embodiment.

In some embodiments, the cleaning elements 206 are not individually attached to the inner bottom of the cleaning chamber 101, but instead they are provided as cleaning heads 1001 that are removably attached to the cleaning chamber, as shown in FIG. 10. The detachable cleaning head 1001 comprises a flat surface, and a plurality of cleaning elements 206 disposed on the flat surface as projections. The cleaning head 1001 may be made from polymers such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. They may be made from any plastic, metal such as aluminum, silver, gold, copper, zinc, iron, silicon, and the like or metal alloy that is used in the art for high load applications. The underside of the cleaning head 1001 may have means to attach to the inner bottom of the cleaning chamber. Attachment may be made through complementary threads, screws, clamps, pins, nuts, threads, rivets and the like known in the art.

In the embodiment shown in FIG. 10, the attachment of the cleaning head 1001 to the cleaning chamber 101 is made through a snug-fit sliding attachment. Grooves in the cleaning head 1001 slide along the elevated ribs 1002 present on the inner walls of the cleaning chamber 101 and snug-fit onto it, keeping the cleaning head 1001 in place when the chamber 101 undergoes reciprocating motions.

FIG. 2C shows the reservoir 105 that is attached under the housing 104 and can be fluidically connected to the cleaning chambers 101. In the embodiment shown, the reservoir is split into two chambers by a partition 207. In this configuration, each reservoir chamber is fluidically connected to one cleaning chamber 101. This allows filling of different solutions in the two reservoir chambers. For example, one reservoir chamber can be filled with a detergent solution and the other can be filled with water. A brush may be cleaned thoroughly with the detergent solution in the first cleaning chamber and then the remnants of detergent removed with water in the second cleaning chamber. In some embodiments, the brush cleaner may have a single cleaning chamber and a reservoir with no compartmentation. In other embodiments, the brush cleaner may have a detachable partition that allows users to attach or remove the partition as and when desired to split or combine the compartments of the reservoir.

The housing 104 shown in FIG. 2B easily fits on top of the reservoir 105 shown in FIG. 2C and is properly aligned with the help of guides 208 that help slide the complementing part on the housing into them. Further, a rubber gasket or the like that fits around the top perimeter of the reservoir 105 could be used to seal the space between the housing 104 and the reservoir 105 to prevent solvent leaks. The gasket could also seat the housing 104 properly on the reservoir 105.

The cleaning chamber 101 and the reservoir 105 are fluidically connected. For example, as shown in FIG. 10A the cleaning chamber 101 may have channels or conduits 1003 that drain the liquids from the cleaning chamber down into the reservoir by gravity-flow. The embodiment shown in FIG. 10A has two draining channels 1003 in each cleaning chamber 101. The conduits or draining channels are represented as downward arrows in FIG. 10B. The dimensions, positioning and number of channels can be increased or decreased to obtain different solvent drain rates from the cleaning chambers.

The liquid from the reservoir 105 are pumped into the cleaning chambers 101 by a motor driven pump 106 (FIG. 3 and FIG. 10B). A port 107 delivers the liquid into the cleaning chamber. The number and placement of the ports 107 around the chambers 101 could be varied to obtain different flow rates or patterns. The flow of the liquids from the reservoir to the cleaning chamber are denoted by upward arrows in FIG. 10B. The flow rate of the liquid that is pumped into the chamber can be regulated by the motor. The presence of a partition between the reservoir chambers allows the use of different solutions in different chambers for step-wise cleaning of brushes in harsh detergents, mild detergents, specialized detergents, other cleaning solvents and water to obtain thorough cleaning. Cycling of the solvents between the reservoir and the cleaning chamber by the pumping action of the motor 106 and draining through the channels or conduits 1003 allows washing, cleaning and flushing of the brushes in a highly efficient manner, reducing the time required to clean brushes.

In some embodiments, the channels or conduits originate at the center of the cleaning head (when present) or the cleaning chamber (then a cleaning head is absent) and drain into the reservoir beneath. In other embodiments, the channels or conduits are connected to a pump that actively drains out solvents from the chamber into the reservoir for cycling between the chamber and reservoir. In another embodiment, used solvents from the chamber do not drain into the reservoir. Instead it drains or is actively pumped into a separate drainage reservoir or a common sink like the ones found in bathrooms or kitchens. This could allow fresh solvent to fill in the chamber from the reservoir as the cleaning progresses and used solvent and debris to be removed continuously or at intervals, depending upon how the drain and/or pumps are programmed to operate.

Figure 5:
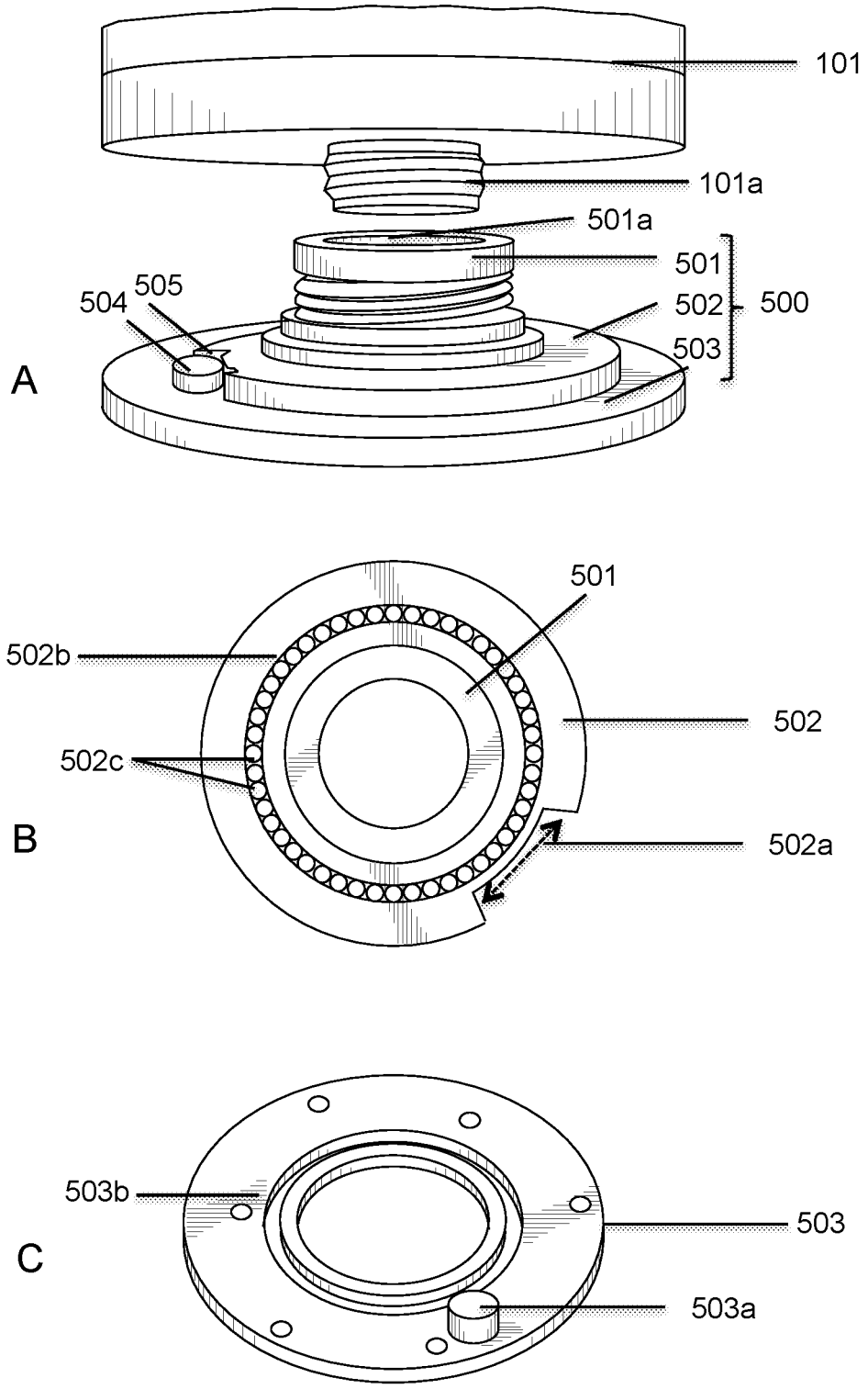
FIG. 5 depicts components of the drive of a brush cleaner according to an embodiment.
Figure 6:
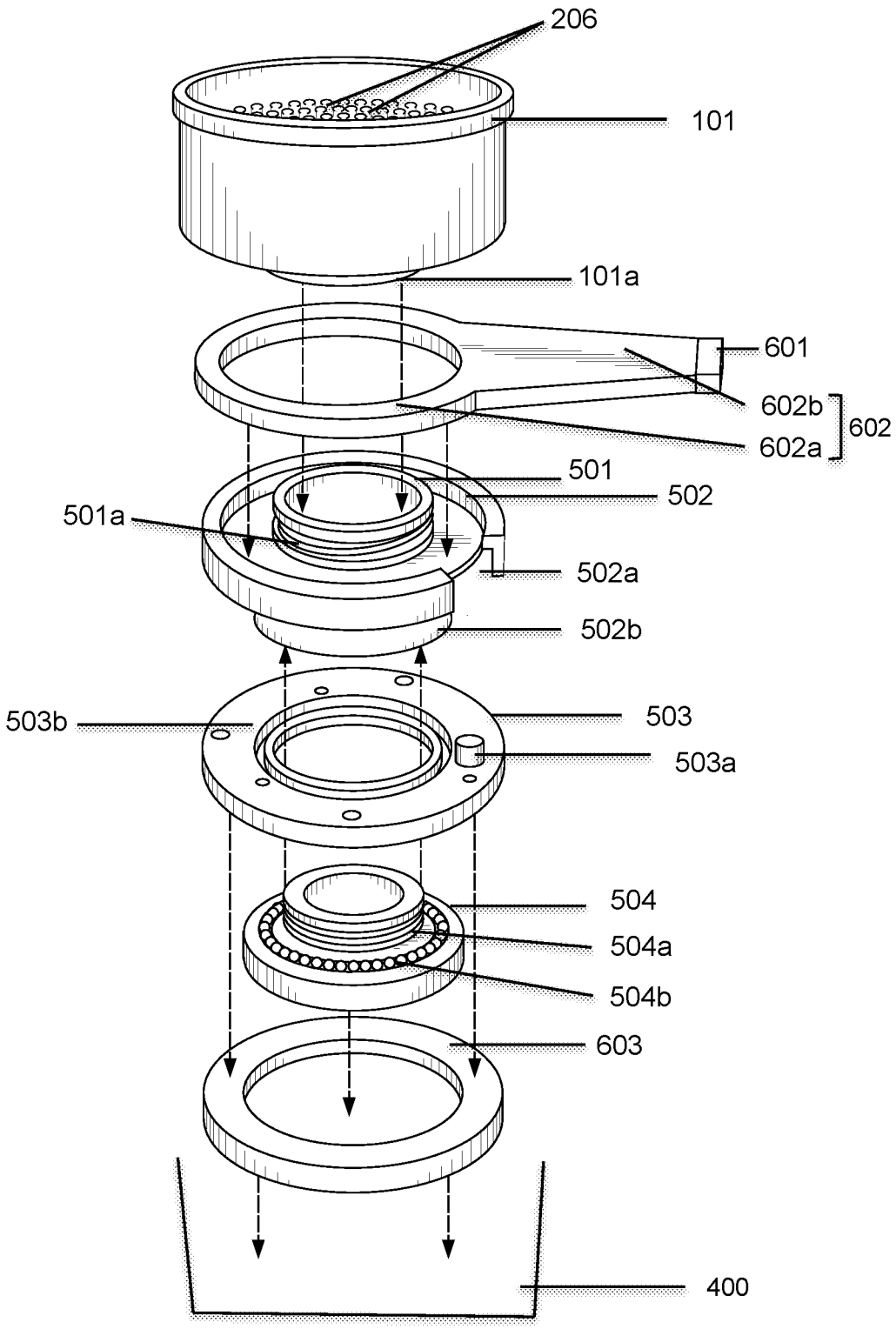
FIG. 6 depicts the components of a drive according to an embodiment.

In some embodiments, the undersurface of the cleaning chamber 101 is attached to a drive 500 (FIGS. 5 and 6). The drive 500 comprises four main parts—a receiver 501, a reciprocating element 502, an anchoring element 503, and an annular member 504. In the exemplary embodiment shown in FIG. 5A, a cleaning chamber 101 is shown along with a complementary receiver 501. The cleaning chamber 101 can be attached to a receiver 501 with the help of a grooved member 101*a* present on the undersurface of the cleaning chamber as shown in FIG. 5A. The grooved member 101*a* fits into complementary grooves 501*a* present on the cylindrical receiver 501. The shape and size of the receiver 501 may be configured to match or accept the size and shape of the grooved member 101*a*. In the embodiments shown in FIG. 1, FIG. 2, FIG. 3, FIG. 4 and FIG. 5, the cleaning chamber 101 is detachable. This allows the easy removal of the chamber for cleaning or for replacement. Alternatively, the cleaning chamber 101 may be permanently attached to the receiver 501. Means of attachment such as adhesives, screws, snug-fit, clamps, pins, nuts, threads, rivets and the like known in the art may be used for attaching the cleaning chamber 101 to the receiver 501. The receiver 501 in FIG. 5A is 10 mm in diameter, 2 mm thick and 15 mm tall and made from Delcrin®Acetal. The receiver 501 may be made from any plastic, metals or alloy materials as described in the disclosure that can be used for high-load mechanical applications.

In the exemplary embodiment shown in FIG. 5A, the receiver 501 is an integral part of the flat circular reciprocating element 502 and the receiver 501 appears as an upper projection from the reciprocating element 502. The upper projection has an inner hole containing grooves 501*a* into which the grooved member 101*a* of a cleaning chamber can be engaged. Alternatively, the receiver 501 may be fabricated as a separate element that is configured to accept the grooved member 101*a* of a cleaning chamber 101 and can be attached to the reciprocating element 502 with the help of screws that are almost flush with the surface of the reciprocating element 502. Means of attachment such as adhesives, screws, snug-fit, clamps, pins, nuts, threads, rivets and the like known in the art may also be used for attaching the receiver 501 to the reciprocating element 502. The shape and size of the reciprocating element 502 may be configured to match the shape and size of the receiver 501 or the cleaning chamber 101 or both. The reciprocating element 502 shown in FIG. 5B is 70 mm in diameter and 2 mm thick and made from Delcrin®Acetal. Alternatively, the reciprocating element 502 may be made from any plastic, or metals or alloy materials as described in the disclosure that can be used for high-load mechanical applications.

The reciprocating element 502 is attached to the anchoring element 503 and the annular member 504 (FIGS. 5 and 6) such that the anchoring element 503 is sandwiched between the reciprocating element 502 and the annular member 504. The annular member 504 has a top portion 504*a* with grooves that engages with grooves on a projection 502*b* present on the lower side of the reciprocating element 502 and sandwiches the anchoring element 503 between the annular member and the reciprocating element (FIG. 6). The size and shape of the reciprocating element 502 may be configured to match the size and shape of the anchoring element 503 or annular member 504 or both. The anchoring element 503 in the exemplary embodiment in FIG. 5 is made from Delcrin®Acetal. Alternatively, the anchoring element 503 may be made from any plastic, metal or alloy material as described above, that can be used for high-load mechanical applications. The anchoring element 503 anchors the drive 500 to the base 400 of the brush cleaner. In some embodiments, additionally, a circular member 603 (FIG. 6) may be present between the anchoring element 503 and the base 400 of the brush cleaner. The anchoring element 503 is attached firmly to the circular member 603 and the circular member 603 is firmly attached to the base of the housing.

In some embodiments, the anchoring element 503 has a cylindrical protrusion 503*a* that extends into the notch 502*a* of the reciprocating element 502 (FIG. 5). The cylindrical protrusion 503*a* may be 5 mm in diameter and 5 mm in length and engages into the notch 502*a* that is 20 mm wide. Since the notch 502*a* is wider than the diameter of the cylindrical protrusion 503*a*, this allows for the reciprocating element 502 to move against the anchoring element 503 in back and forth circular reciprocating motions. The width of the notch determines the range of motion of the reciprocating element, which in turn causes the cleaning chamber to move in back and forth circular reciprocating motions. The size of the protrusion and the notch may be varied to obtain desired range of motions in a brush cleaner.

A shaft 602 is attached to the upper surface of reciprocating element 502 (FIG. 6), and connects the drive 500 with a permanent magnet 601. The oscillations of the permanent magnet 601 are conveyed to the drive 500 via the shaft 602. In the exemplary embodiment, the shaft 602 is an oblong structure having a proximal end in the shape of an annular disc 602*a* attached to the reciprocating element 502, and a distal end 602*b* attached to permanent magnet 601. The proximal end 602*a* is attached to the reciprocating element 502 using screws that are almost flush with the surface of the annular disc. Alternatively, means of attachment such as adhesives, screws, snug-fit, clamps, pins, nuts, threads, rivets and the like known in the art may also be used for attaching the connecting element to the reciprocating element. The shape and size of the proximal end 602*a* of the connecting element 601 may be configured to match the shape and size of the other elements of the drive or the cleaning chamber. For example, the proximal annular disc 602*a* may have a gap such that it fits around the receiver 501 when it is an integral part of the reciprocating element 502. The shape and size of the distal end 602*b* of the shaft 602 may be configured to the size, shape and strength of the permanent magnet 601 that is attached to it. In the embodiments shown in FIGS. 1-4, the connecting element is 65 mm broad at its proximal end, 40 mm broad at its distal end, 90 mm long, 2 mm thick and made from polycarbonate. The shaft 602 may be made from any plastic, metal or alloy material described herein that can be used for high-load mechanical applications. In the exemplary embodiment, a permanent n52 magnet 601 that is 10 mm broad 20 mm tall and 5 mm thick is attached to the distal end 602*b* of the shaft 602 using an adhesive. Alternatively, means of attachment such as screws, snug-fit, clamps, pins, nuts, threads, rivets, adhesives and the like known in the art may also be used for attaching the permanent magnet to the connecting element. The size, shape and strength of the permanent magnet may be configured for different cleaning applications.

The anchoring element 503 acts as a swivel for the movement of the reciprocating element 502. The upper surface 503*b* of the anchoring element 503 and the lower surface 502*b* of reciprocating element 502 have complementary grooves along which balls 502*c* are placed that acts as a means to reduce friction between anchoring element 502 and reciprocating element 503 (FIG. 5B and FIG. 5C). In addition, the upper surface of the annular member 504 and the lower surface of the anchoring element 503 both have complementary grooves along which bearings can be placed that acts as a means to reduce friction between the annular member 504 and the anchoring element 503. A schematic of an embodiment is depicted in FIG. 6 and the grooves are shown as 504*b*.

In an exemplary embodiment, 2 mm diameter galvanized steel balls are used as shown in FIG. 5B. The size and composition of the balls 502*c* may be increased or decreased for configuring the drive to cleaning applications where increased or decreased strengths are required. The size and shape of the grooves on 502*b*, 503*b* and 504*b* may be configured to accommodate the different sizes of balls that are used as a means to reduce friction. This may be done separately or in combination with changes in the shape and configuration of the various elements of the drive. Natural, petroleum-based or synthetic lubricants may be used on the balls to increase their functionality in the drive. Further, the grooves may be coated or fabricated with materials that enhance the life of the balls as well as the drive.

Figure 7:
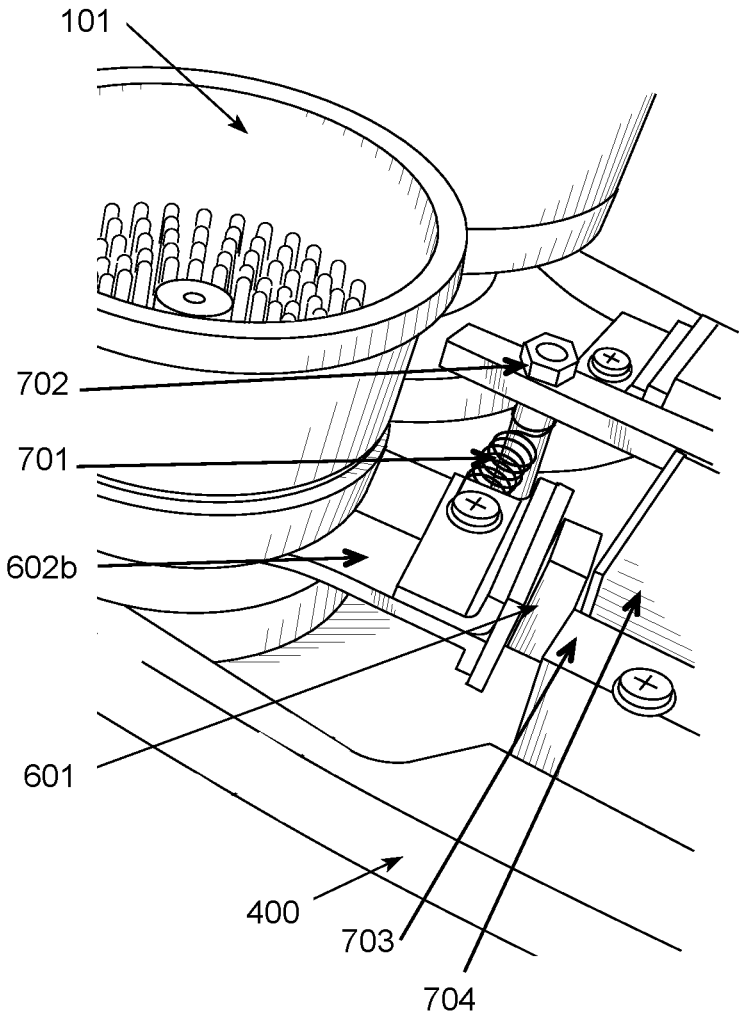
FIG. 7 depicts a side view of a brush cleaner showing the components of a drive and motor of a brush cleaner according to an embodiment.
Figure 8:
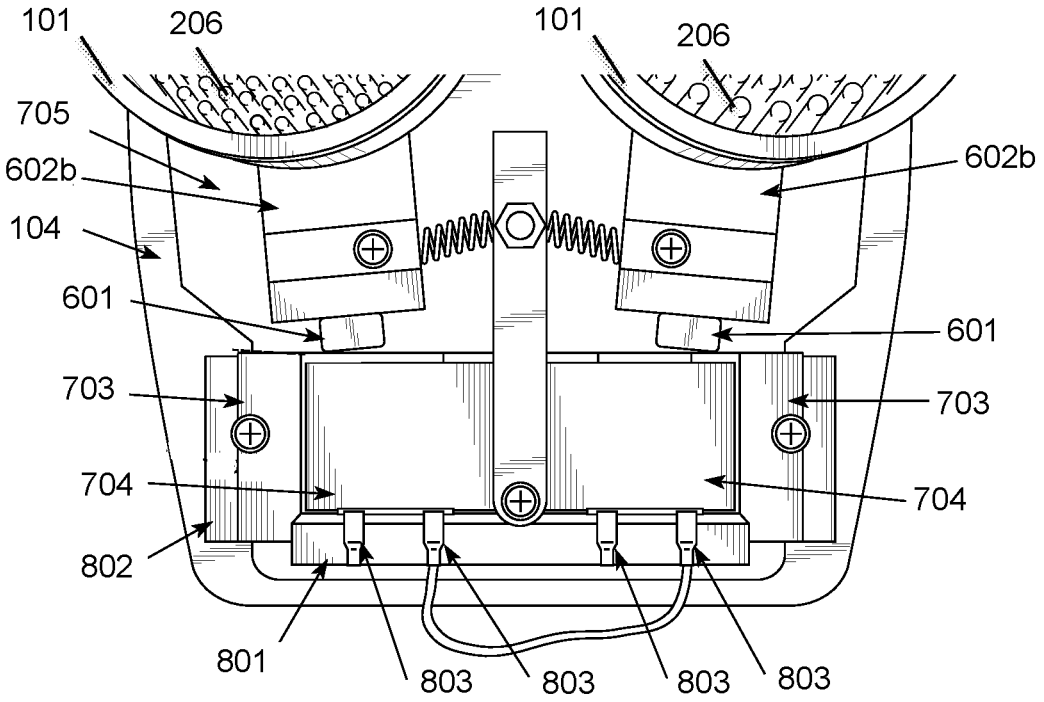
FIG. 8 depicts a top view of a brush cleaner showing the components of a drive and motor of a brush cleaner according to an embodiment.
Figure 9:
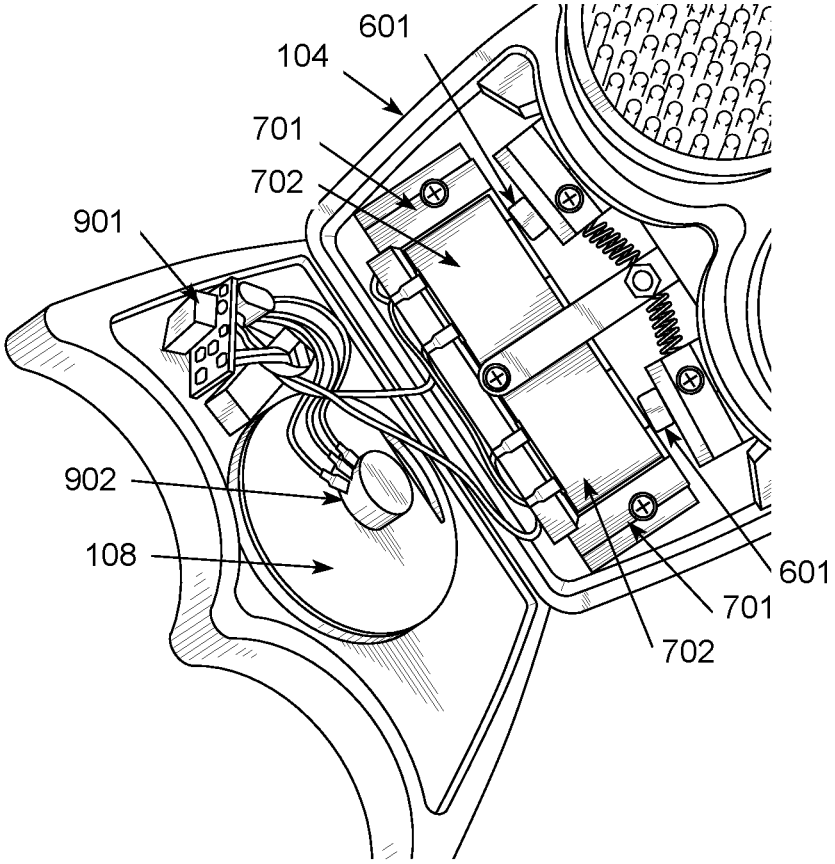
FIG. 9 depicts a view of the components of a control switch of a brush cleaner according to an embodiment.

In some embodiments, the permanent magnet 601 is placed in close proximity to an electromagnet. The electromagnet comprises a stator (or core) 703 and coil (or winding) 704. The vibrations of the permanent magnet 601 are induced by the electromagnet due to its fluctuating magnetic field. Further, a spring 701 connects the distal end 602*b* of the shaft 602 to an anchoring screw 702, as shown in FIG. 7. The spring 701 functions as a tether to restrict the movement of the shaft 602, which is caused in response to the vibratory movement of the permanent magnet 601. The combination of the shaft 602, spring 701, the cylindrical protrusion 503*a* and the notch 502*a* allows the reciprocating element 502 and the annular member 504 to move back and forth in a circular reciprocating motion. The distance moved is determined by the width of the notch, when permanent magnet 601 moves in response to the oscillations from the electromagnet. FIGS. 7-9 depict embodiments of a brush cleaner having two of each of the following: cleaning chamber 101, drive 500, shaft 602, permanent magnet 601, electromagnet with stator 703 and coil 704.

A very small distance, for example 1 mm or less, may separate the permanent magnet 601 from an electromagnet that is made of stators 703 and coils 704 as shown in FIG. 7 and FIG. 8. The stators 703 are made from a stack of laminated Nickel-Iron sheets commonly used as a stator or core for motors. Other metals or metal alloys such as Iron, Iron-Molybdenum, Iron-Molybdenum-Nickel and the like may be also used for stators. Additionally, the number of plates that form the final stack of laminates in the core may be increased or decreased depending upon cleaning applications. Coils 704 around the arms of the stator are made from 36 American Wire Gauge Copper. The coils 704 may be modified and configured for cleaning applications that require increased or decreased power using methods known in the art. The stators 703 in the exemplary embodiments in FIG. 1, FIG. 2 and FIG. 4 are capable of 110v and 60 Hz. The coils 704 are held in place by a coil holder 801 that attaches the coils to the base of the housing (FIG. 8). In the embodiments in FIGS. 7-9, a screw is used to attach the coil holder 801 to the base of the housing. Alternatively, means of attachment such as snug-fit, clamps, pins, nuts, threads, rivets, adhesives and the like known in the art may also be used for attaching the coil holder 801 to the base of the housing. The stators 703 are covered partly by stator covers 802 that insulate their sides and also allow them to be anchored to the base of the housing with the help of the coil holder 801. The stator covers could be extended to cover the entire electromagnet. The stator covers in the embodiments in FIGS. 1-5 and FIGS. 7-8 are made from acrylonitrile butadiene styrene (ABS).

In the embodiment shown in FIG. 8, each permanent magnet-electromagnet pair constitutes a vibratory motor. Thus, in the embodiment in FIG. 8, there are two vibratory motors. The two vibratory motors may oscillate 10-1000 times per second depending upon the input to the coils. In turn, the cleaning chambers oscillate with circular reciprocating motions of 10-1000 times per second. For example, the circular reciprocating motions may be 10 times per second, 100 times per second, 200 times per second, 400 times per second, 600 times per second, 1000 times per second, and the like. The oscillations of the vibratory motor may be increased or decreased by altering the amount of current that reaches the coil. For example, this may be done by adding a potentiometer to the circuit. In some embodiments, the two cleaning chambers 101 may have identical circular reciprocating motions frequency or they may have different circular reciprocating motions. For example, one cleaning chamber may have faster frequency (400 times per second) and the other cleaning chamber may have a slower frequency (100 times per second).

The leads 803 from the two vibratory motors are connected in parallel allowing them to be turned on at the same time by simple switches known in the art. The leads 803 can be connected to an AC outlet and powered on. Powering of the electromagnet through the leads 803 (FIG. 8) produces oscillations in the magnetic field, which in turn moves the permanent magnets 601, which causes the drive 500 to move. The addition of adjustable or fixed capacity resistors, capacitor, potentiometers, circuitry, wiring and the like known in the art between the power source and the coil will allow efficient operation of both the cleaning chambers. Further, additional circuit controls, circuitry, switches and wires may be provided as necessary and by methods known in the art to allow independent control and operation of the two cleaning chambers.

The vibratory motor (permanent magnet-electromagnet pair) disclosed herein may offer many distinct advantages over more conventional mechanical systems, including very high and low speeds, high acceleration, almost zero maintenance (since there are no contacting parts) and high accuracy. They also reduce the number of components needed to make a functional motor. These additional components such as a gearbox may diminish performance and life of the more conventional motors. Nonetheless, the drive described herein may be used with direct current (DC) motors by configuring it by methods known in the art to produce oscillating or vibrating motions with the help of a DC motor.

The housing 104 and the base 400 may be made from ABS or other plastics, such as polyoxymethylene, polyurethane, a polyester, an epoxy resin, a phenolic resin, polyethylene (PE), polypropylene (PP), polyvinyl chloride, polystyrene, or any combination thereof. Other materials such as metals or metal alloys alone or in combination as described herein may also be used.

In some embodiments, the housing 104 covers the drive 500 and the motors, and does not cover the cleaning chambers 101 and the brush holders 102. FIG. 1 depicts a closed view where the housing 104 fully covers the drive and the motor and includes a turnable switch 108 that can be used to turn the cleaner on or off and also to set the frequency of reciprocating motions of the cleaner. FIG. 9 depicts an open view where the housing 104 displays a capacitor 901 and potentiometer 902 attached to the inner side. The potentiometer 901 allows control of the reciprocating frequency of the cleaning chamber through the switch 108 located on the outer side of the housing. Other controls and user interfaces such as, graphic video display, LCD screen, timers, audio signals, icons, LED indicators may be associated with the housing. Further, the user interface can include any type of controller having an algorithm, hardware or software for programing the brush cleaner. The hardware/software program can be configured to control the length and frequency of the cleaning cycle, the speed of the cleaning chamber and the speed of the brush holder.

Also disclosed herein are methods to clean the brushes. In one embodiment, a cleaning cycle is initiated by attaching one or more brushes to the brush holder 102 through the brush securement members 203, and sliding the brush holder 102 into the receptacle 204. This arrangement would place the bristle end of the brushes inside the cleaning chamber 101, and in close proximity to the cleaning elements 206. When the brush cleaner is powered, the solvent is pumped from the reservoir 105 into the cleaning chamber 101, the brush securement members 203 rotate and the cleaning chambers 101 move in rapid circular reciprocating motions, and cause the bristles to rub against the cleaning elements 206 present within the cleaning chamber 101 in the presence of a cleaning solvent. The circular reciprocating motions may be at a frequency of 10 to 1000 per second. The reciprocating motions may be range of 0.01 mm to 20 mm. Due to the dual motions of the brush holder (rotatory motion) and the cleaning chamber (back and forth circular reciprocating motion) and the continuous recycling of the cleaning solvent between the reservoir and the chamber, the brushes are cleaned rapidly and efficiently. Each cleaning cycle can include a wash cycle (using detergents) in the first cleaning chamber, and a rinse cycle (using water) in the second cleaning chamber. The wash cycle may be from about 30 seconds to about 10 minutes, and the rinse cycle may last from about 30 seconds to 5 minutes. In some embodiments, the wash cycle and the rinse cycle can be performed multiple times until the desired cleaning is achieved. In some embodiments, a wash cycle may be followed by multiple rounds of rinse cycle.

In some embodiments, areas of the brush cleaner, such as the bottom surface of the reservoir and/or the bottom of the housing, that contact a resting surface during the operation or storage of the brush cleaner may have anti-skid or non-slip devices such as suction cups or anti-slip pads or tapes or the like. They will hold the brush cleaner stably in position during its operation or storage preventing it from moving around.

Since the solvent circulates between the cleaning chamber and the reservoir continuously during the operation of the brush cleaner, the turbidity of the solvent may gradually increase when the dirt from the brushes' bristles are dislodged. In some embodiments, the reservoir may have a sensor to detect the turbidity of the solvent, and may indicate the cleaning progress. For example, a constant rate of increase in the turbidity may indicate that the brushes are still dirty, however, if the turbidity remains constant over time it may indicate that the brushes are clear of dirt and the cleaning process is complete.

The sliding brush holder allows easy transfer of brushes from one cleaning chamber to the other for multiple rounds of cleaning. Upon completion of cleaning, the brush holder can be lifted and kept in a standby position on the receptacle, which shuts down the motor powering the brush holder and allows the brush holder to rest in the receptacle. This resting position can be used for drying brushes without removing them from the brush holder.

Also disclosed herein are kits for cleaning brushes. The kits may contain disposable cleaning chambers, disposable cleaning elements, cleaning heads as described herein. In one embodiment, the kit may include a cleaning chamber 101 with a plurality of cleaning elements 206 inside the chamber. Further, the kit may further contain step-by-step instructions to remove and replace the cleaning chamber of the brush cleaner. The kit may further contain means of attachment such as adhesives, screws, clamps, pins, nuts, threads, rivets and the like that may be necessary to fix a new cleaning chamber provided in the kit to the brush cleaner. In another embodiment, a kit may also include a plurality of cleaning elements 206 for replacing worn out cleaning elements. Further, the kit may also include a plurality of disposable cleaning heads 1001 carrying cleaning elements.

The brush cleaner device described herein may increase the efficiency of brush cleaning by using reciprocating motions that are small in range of motion and rapid in terms of reciprocating movements made per unit time. In addition, the ripples and currents that are generated within the cleaning chamber due to the rapid reciprocating movements may aid in cleaning the brushes rapidly, albeit gently. This may be contrasted with the harsh mechanical scrubbing of the brushes against a cleaning surface, which is currently prevalent in the art. Further, the option to use detachable cleaning chambers and detachable cleaning heads provides the user with the ability to replace worn cleaning chambers rather replacing the entire brush cleaner. The option to use two cleaning chambers instead of one may also save time as it provides two readily available steps of cleaning without changing the cleaning medium or solvent in the cleaning chamber. The brush cleaner disclosed herein may be used to clean any brushes, such as makeup brushes, paint brushes, tooth brushes and the like. The embodiments disclosed herein may find applications in personal care industry, such as beauty salons, spas, hotels, and the like.

In addition, the reciprocating motions of the cleaning elements can be employed as scrubbers to clean any surface. For example, the cleaning heads 1001 when used without a cleaning chamber would operate as a scrubber. The cleaning elements may be smooth or non-abrasive, and are intended to cause minimal damage of the cleaning surface. Alternatively, the cleaning elements may be rough or abrasive, and are intended to cause a stripping effect on surfaces. The stripping effect may be used to remove materials (for example to make a depression on a surface or to reduce the thickness of a material or to remove bumps and make a surface smooth) or layers (for example a layer or paint) or imperfections from surfaces. The stripping effect may also be used to introduce different contours or patterns on surfaces.

EXAMPLES

Cleaning a Makeup Brush with a Brush Cleaner:

A dirty makeup brush was subjected to cleaning using the brush cleaner of FIG. 1. A large dirty foundation brush was inserted into the brush holder and the brush holder was inserted into the receptacle. The rotation speed of the brush holder was set at 40 rpm and the brush was placed in the first cleaning chamber containing 50 ml of a commercial brush cleaning solution. The brush cleaner was operated for 1 minute. The cleaning efficiency was monitored by a turbidometer. About 10 ml of the cleaning solution was taken from the cleaning chamber for turbidometric analysis using a Lutron TU-2016 turbidity meter. New cleaning solution was added into the cleaning chamber and to the reservoir, and the process was repeated. Similar 10 ml samples were collected at 1-minute intervals for 30 minutes. Reduction in turbidity of the cleaning solution over a period of time indicated the cleaning efficiency, and an absence of turbidity was taken as a measure of complete cleaning. The study showed that the brushes were completely clean within 3 minutes. When the process was repeated with a rotational speed of 100 rpm, the brushes were completely clean within 1-2 minutes. Following this, the brush holder was placed in the second cleaning chamber filled with water. The brush cleaner was operated for 2 minutes to remove any residual cleaning solution. At the end of the cycle the brush holder was slid into a resting position in the receptacle to allow the brushes to air dry.

While preferred embodiments have been shown and described, various modifications and substitutions may be made thereto without departing from the spirit and scope of the method and device. Accordingly, it is to be understood that the present method and device has been described by way of illustration and not limitation.

What is claimed is:

1. A brush cleaner comprising:

a base;

at least one vibratory motor mounted on the base, wherein the vibratory motor comprises a permanent magnet and an electromagnet;

the at least one vibratory motor connected to a drive, wherein the drive is configured to provide circular reciprocating motions;

at least one cleaning chamber in contact with the drive, and a plurality of cleaning elements disposed within the cleaning chamber;

at least one detachable brush holder comprising a proximal end and a distal end, the proximal end in contact with the base, and the distal end comprising a brush securement member connected to a rotary motor; and a reservoir attached to the base.

2. The brush cleaner of claim 1, wherein the permanent magnet is in close proximity to the electromagnet and the permanent magnet is configured to vibrate in response to fluctuating magnetic field of the electromagnet.

3. The brush cleaner of claim 1, wherein the at least one vibratory motor is connected to the at least one drive by a shaft, wherein the shaft comprises a proximal end attached to the drive and a distal end attached to the permanent magnet of the vibratory motor.

4. The brush cleaner of claim 3, wherein the shaft and the drive are configured to convert the vibratory motions of the permanent magnet into circular reciprocating motions.

5. The brush cleaner of claim 1, wherein the cleaning chamber is detachable from the drive.

6. The brush cleaner of claim 1, wherein the cleaning chamber has a height of about 1 inch to about 16 inches, and a diameter of about 1 inch to about 16 inches.

7. The brush cleaner of claim 1, wherein the cleaning chamber is configured to undergo circular reciprocating motions of about 10-1000 times per second.

8. The brush cleaner of claim 1, wherein the plurality of cleaning elements are disposed at a bottom of the cleaning chamber, and the cleaning elements are about 0.1 inches to 3 inches in length, and about 0.1 inches to 3 inches in thickness.

9. The brush cleaner of claim 1, wherein the brush securement member of the brush holder is configured to hold and rotate one or more brushes above the cleaning chamber.

10. The brush cleaner of claim 9, wherein the brush securement member is configured to undergo 20-200 rotations per minute.

11. The brush cleaner of claim 1, wherein the rotary motor of the brush holder is configured to operate when the brush holder contacts the base of the brush cleaner.

12. The brush cleaner of claim 1, wherein the reservoir comprises a solvent flow system that is configured to circulate a solvent between the cleaning chamber and the reservoir.

13. The brush cleaner of claim 1, further comprising a housing encasing the at least one vibratory motor, drive, and part of the base of the brush cleaner.

14. The brush cleaner of claim 1, further comprising at least one solvent dispensing port adjacent to the at least one cleaning chamber.

15. The brush cleaner of claim 1, wherein the solvent flow system is configured to circulate 20-200 ml of solvent per minute.

16. A brush cleaner comprising:

a base;

a first vibratory motor mounted on the base and a second vibratory motor mounted on the base, wherein each vibratory motor comprises a permanent magnet and an electromagnet;

the first vibratory motor connected to a first drive, wherein the first drive is configured to provide first circular reciprocating motions;

the second vibratory motor connected to a second drive, wherein the second drive is configured to provide second circular reciprocating motions, wherein the first and the second circular reciprocal motions are identical or different;

a first cleaning chamber in contact with the first drive, and a second cleaning chamber in contact with the second drive;

at least one detachable brush holder comprising a proximal end and a distal end, the proximal end in contact with the base, and the distal end comprising a brush securement member connected to a rotary motor; and a first reservoir attached to the base and a second reservoir attached to the base.

17. The brush cleaner of claim 16, wherein the first cleaning chamber and the second cleaning chamber are configured to undergo circular reciprocating motions of about 10-1000 times per second.

18. The brush cleaner of claim 16, wherein the brush securement member is configured to undergo 20-200 rotations per minute.

19. The brush cleaner of claim 16, wherein the first reservoir comprises a first solvent flow system that is configured to circulate a solvent between the first cleaning chamber and the first reservoir, and the second reservoir comprises a second solvent flow system that is configured to circulate a solvent between the second cleaning chamber and the second reservoir.

20. The brush cleaner of claim 19, wherein the first solvent system and the second solvent flow system are configured to circulate 20-200 ml of solvent per minute.

* * * * *